US006810224B2

(12) United States Patent
Ahn

(10) Patent No.: US 6,810,224 B2
(45) Date of Patent: Oct. 26, 2004

(54) DRIVING APPARATUS AND METHOD FOR A DOUBLE-SIDE PRINTABLE MACHINE

(75) Inventor: Byung-sun Ahn, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 4 days.

(21) Appl. No.: 10/405,501

(22) Filed: Apr. 3, 2003

(65) Prior Publication Data

US 2003/0235449 A1 Dec. 25, 2003

(30) Foreign Application Priority Data

Jun. 21, 2002 (KR) ..... 2002-34974

(51) Int. Cl.[7] ..... G03G 15/00
(52) U.S. Cl. ..... 399/167; 399/401; 399/405
(58) Field of Search ..... 399/38, 75, 167, 399/320, 388, 401, 405

(56) References Cited

U.S. PATENT DOCUMENTS 4,931,834 A * 6/1990 Suga ..... 399/75
5,701,549 A * 12/1997 Portig et al. ..... 399/167 X
5,884,137 A * 3/1999 Shida et al. ..... 399/401
5,970,286 A * 10/1999 Numazu et al. ..... 399/167
5,974,283 A * 10/1999 Cho ..... 399/75
6,473,579 B1 * 10/2002 Suzuki et al. ..... 399/405 X

* cited by examiner

*Primary Examiner*—Sandra L. Brase
(74) *Attorney, Agent, or Firm*—Staas & Halsey LLP

(57) ABSTRACT

A driving apparatus for a double-side printable office machine includes a first driving part driving a pickup/transport unit, developing unit, and a second reverse-transport roller of a double-side printing unit, and a second driving part driving a fixing unit, a first reverse-transport roller of the double-side printing unit, and a paper discharge unit, and a controller controlling the first and second driving parts. A driving method in the double-side printable office machine includes stopping a first driving motor of the first driving part as a rear end of a sheet passes through the developing unit and reaches a certain position of a paper transport path, and driving the first driving motor of the first driving part in a paper transport direction again as the sheet enters the paper return path and reaches a certain position of the paper return path. Accordingly, the double-side printable office machine can reduce a size and a waste toner amount of the developing unit to decrease a manufacturing cost and reduce wear and tear and noise of the developing unit to enhance a lifespan and reliability of products by controlling paper pickup/supply and developing operations to be performed separately from an operation of fixing, discharging, and, in particular, returning sheets for double-side printings.

48 Claims, 3 Drawing Sheets

DRIVING APPARATUS AND METHOD FOR A DOUBLE-SIDE PRINTABLE MACHINE

CROSS-REFERENCE TO RELATED APPLICATIONS

This application claims the benefit of Korean Patent Application No. 2002-34974, filed Jun. 21, 2002, in the Korean Intellectual Property Office, the disclosure of which is incorporated herein by reference.

BACKGROUND OF THE INVENTION

1. Field of the Invention

The present invention relates to an office machine, such as a laser printer, photocopier, or the like, and more particularly, to driving apparatus and method in a double-side printable office machine which can reduce a waste toner amount and a volume of a developing unit, decrease wear and tear and noise of the developing unit, and prevent unnecessary driving of the developing unit during fixing, discharging and, in particular, returning a sheet of paper by driving, fixing, discharging, and returning operations for double-side printings separately from paper pickup/supply and developing operations.

2. Description of the Related Art

In general, as shown in FIG. 1, a double-side printable office machine, such as a double-side printing laser printer 1, includes a paper-supplying cassette 11 detachably mounted to a frame 10 of a main body of the double-side printable laser printer 1, a pickup/transport unit 6 picking up and transporting a sheet of paper P loaded in the paper-supplying cassette 11, a developing unit 30 forming a toner image on the sheet P, a fixing unit 40 heat-pressing the toner image formed on the sheet P to fix the toner image as a visible toner image, a paper discharge unit 50 discharging the sheet P on which the visible toner image is fixed by the fixing unit 40, and a double-side printing unit 80 re-feeding a one-side printed sheet P through the fixing unit 40 to the developing unit 30 to print the other side of the sheet P.

The paper-supplying cassette 11 is installed in a lower side of the frame 10 of the main body and supports the sheet P through a paper-pressing plate 13 supported by an elastic spring 12 so that the sheets P elastically ascend and descend.

Over the paper-supplying cassette 11 is installed the pickup/transport unit 6 sequentially picking up and transporting the sheets P loaded in the paper-supplying cassette 11 one by one. The pickup/transport unit 6 has a first paper sensor (not shown) sensing whether the sheets P are loaded in the paper-supplying cassette 11, a first pickup roller 7 picking up the sheets P loaded in the paper-supplying cassette 11, and a transport roller 23 and reverse roller 24 transporting the picked-up sheet P to the developing unit 30 along a paper transport guide 22 forming a paper transport path A.

In order to manually supply the sheet P, the pickup/transport unit 6 includes a manual paper-supplying cassette 27 mounted to protrude toward a front of the main body, a second paper sensor (not shown) sensing whether the sheet P is loaded in the manual paper-supplying cassette 27, and a second pickup roller 25 picking up the sheet P loaded in the manual paper-supplying cassette 27 and transporting the sheet P toward a register roller 28 and a back-up roller 29. As described above, the manual paper-supplying cassette 27, the second paper sensor, and the second pickup roller 25 constitute a manual feeder.

The developing unit 30 is detachably installed on the frame 10 of the main body, is disposed over the pickup/transport unit 6, and includes a photosensitive drum 32 forming an electrostatic latent image by a laser beam emitted from a laser scanning unit (LSU) 76 based on an image signal, a charging roller 49 charging the photosensitive drum 32, a developing roller 47 developing the electrostatic latent image formed on the photosensitive drum 32 with toner to form the toner image, a cleaning blade 48 cleaning a toner waste remaining on a surface of the photosensitive drum 32 after the toner image is transferred to the sheet P, and a waste toner bin 46 storing the toner waste.

Under the photosensitive drum 32 of the developing unit 30 is installed a transfer roller 66 transferring the toner image formed on the photosensitive drum 32 to the sheet P.

The fixing unit 40 pressing and fixing the toner image has a fixing roller 41 and a fixing backup roller 42.

The paper discharge unit 50 has first, second, and third paper discharge rollers 51, 55, and 60 and backup rollers 52, 63, 64, and 65 disposed along the paper transport guide 22 downstream in a paper transport direction of the fixing unit 40, and discharges the sheet P on which the toner image is fixed by the fixing unit 40, to an external paper discharge cassette 67.

The double-side printing unit 80 includes a paper reverse-transport guide 62 constituting a paper return path B for re-feeding a one-side printed sheet P to the developing unit 30 to print another toner image on a reverse side of the sheet P, a paper transport direction switching guide 54 directing a paper transportation so that the sheet P is transported to the paper return path B upon the double-side printing, and first and second reverse-transport rollers 70 and 90 transporting the sheet P through the paper transport path B.

The paper transport direction switching guide 54 is disposed at a position which the paper return path B comes across the paper transport path A, and is disposed upstream in the paper transport path A of the third paper discharge roller 60 of the discharge unit 50, thereby directing the sheet P to the paper return path B for the double-side printing.

In a double-side printing process of the laser printer 1 constructed as above, first, the sheet P loaded in the paper-supplying cassette 11 or in the manual paper-supplying cassette 27 is picked up by the corresponding first and second pickup rollers 7 and 25 based on an operation or a non-operation of the second paper sensor to automatically or manually feed the sheet P, and conveyed to the developing unit 30 through the register roller 28 along the paper transport guide 22.

While the sheet P is being conveyed to the developing unit 30, the electrostatic latent image is formed on the photosensitive drum 32 of the developing unit 30 by the laser beam emitted from the LSU 76 according to the image signal, and the toner is attracted to the electrostatic latent image developed on the photosensitive drum 32 by the developing roller 47 so that the electrostatic latent image is developed to the toner image in a visible form.

The toner image formed on the photosensitive drum 32 is transferred, when the sheet P is transported to the developing unit 30 along the paper transport guide 22, on one side of the sheet P, that is, on an upper side of the sheet P by the transfer roller 66, and the toner image transferred on the upper side of the sheet P is fixed on the upper side of the sheet P by the fixing roller 41 and the fixing backup roller 42 which constitute the fixing unit 40.

After the toner image is transferred on the upper side of the sheet P from the photosensitive drum 32, the toner waste remaining on the surface of the photosensitive drum 32 according to a transfer efficiency is removed by the cleaning blade 48 and stored in the waste toner bin 46 located below the cleaning blade 48.

The sheet P passing through the fixing roller 41 and the fixing backup roller 42 progresses into the third paper discharge roller 60 by the first and second paper discharge roller 51 and 55. At this time, the sheet P pushes a third paper sensor 44 located downstream in the paper transport direction of the fixing roller 41, and, accordingly, the third paper sensor 44 senses a passage of the sheet P.

At this time, when the printer 1, performs a one-side printing mode, the sheet P is discharged to the paper discharge cassette 67 through the third paper discharge roller 60.

However, when the printer 1 carries out a double-side printing mode, the third paper discharge roller 60 is driven to be reversely rotated by a controller as a certain period of time lapses after a rear end of the sheet P passes through the third paper sensor 44, that is, as the rear end of the sheet P reaches downstream in the paper transport direction of the switching guide 54 to be extended to the paper return path B using a stiffness of the sheet P itself. As a result, the sheet P is not externally discharged out of the printer 1, but progresses into the paper reverse-transport guide 62.

The sheet P transferred into the paper reverse-transport guide 62 is conveyed toward the second reverse-transport roller 90 by the first reverse-transport roller 70, and conveyed again to the developing unit 30 through the transport roller 23 and the register roller 28 along the paper transport guide 22 from the second reverse-transport roller 90, and the sheet P is discharged to the external paper discharge cassette 67 after the reverse side of the sheet P, that is, the lower side of the sheet P is printed as stated above.

However, as shown in FIG. 2, respective constituents of the conventional laser printer 1 as described above are constructed to be operated by a first driving part 15 driven by a first driving motor 15*a* and a second driving part 57 driven by the second driving motor 57*a*.

That is, the first driving part 15 has a first pickup roller gear 20*a*, a transport roller gear 23*a*, a reverse roller gear 24*a*, a second pickup roller gear 25*a*, a register roller gear 28*a*, a photosensitive drum gear 32*a*, a fixing roller gear 41*a*, first and second paper discharge roller gears 51*a* and 55*a*, and first and second reverse-transport roller gears 70*a* and 90*a* which are respectively coupled to corresponding rollers to be associated in operation with the first driving motor 15*a* by plural mid-connection or idle gears 16, 17, 18, 19, 20, 21, 31, 33, 34, 35, 36, 37, 38, 43, 45, 53, and 61, thereby rotating in the paper transport and return directions the first pickup roller 7, the transport roller 23, the second pickup roller 25, the register roller 28, the photosensitive drum 32 of the developing unit 30, the fixing roller 41 of the fixing unit 40, the first and second paper discharge rollers 51 and 55 of the paper discharge unit 50, and the first and second reverse-transport rollers 70 and 90 of the double-side printing unit 80.

The second driving part 57 has a third paper discharge roller gear 60*a* connected to be associated with the second driving motor 57*a* through mid-connection gears 58 and 59 to forward or backward drive the third paper discharge roller 60 so that the sheet P passing through the first and second paper discharge rollers 51 and 55 is discharged through the third paper discharge roller 60 in the one-side printing mode or returned to the paper reverse-transport guide 62 in the double-side printing mode.

As stated above, in the conventional double-side printing laser printer 1, the first driving part 15 carries out the operations of all the constituents except for the third paper discharge roller 60, that is, the operations of sheet pickups/supplies, developments, fixings, discharges, and reverse transports in the double-side printing mode, so that the first driving part 15 does not remain stationary, but continues to be driven from the beginning to the end of printing together with the second driving part 57.

Accordingly, when the sheet P is developed, fixed, and discharged, particularly, when the sheet P is returned to the paper reverse-transport path B in the double-side printing mode, the photosensitive drum 32 of the developing unit 30 is unnecessarily rotated with no load, and, accordingly, constituents of the photosensitive drum 32 of the developing unit 30 are worn and torn as well as generate noise, thereby reducing a lifespan and reliability of the printer 1.

Further, when the photosensitive drum 32 is rotated with no load, the toner attached to the surface of the developing roller 47 is attracted to and rotated with the photosensitive drum 32 by composite forces, such as potential differences on the surface of the photosensitive drum 32, and eventually collected into the waste toner bin 46 by the cleaning blade 48 as the waste toner.

As described above, as the photosensitive drum 32 is unnecessarily rotated for a long time, an amount of the toner used increases, and, accordingly, problems are brought out in that it is required to increase a volume of the waste toner bin 46 and the amount of the toner in designing the printer 1 so that a manufacture cost increases, and sizes of devices, such as the developing unit or the like, increase.

Further, in the conventional double-side printing laser printer 1, the developing unit 30 and the fixing unit 40 should be disposed close to each other in order to drive the developing unit 30 and the fixing unit 40 by one motor, that is, the first driving motor 15*a*, so that the waste toner can be fused on the photosensitive drum 32 of the developing unit 30, the cleaning blade 48, and the waste toner bin 46 by heat for fixing, and thereby a fatal problem, such as disablements or breakdowns of the corresponding constituents of the printer 1, can occur.

SUMMARY OF THE INVENTION

The present invention has been devised to solve the above and/or other problems, so it is an aspect of the present invention to provide driving apparatus and method in a double-side printable office machine which can not only reduce a size and a waste toner amount of a developing unit to decrease a manufacturing cost, but also reduce wear and tear and noise of the developing unit to enhance a lifespan and reliability of products by controlling paper pickup/supply and developing operations separately from an operation of fixing, discharging, and returning sheets for double-side printings.

It is another aspect of the present invention to provide driving apparatus and method in a double-side printable office machine which can prevent damage on a developing unit due to fixing heat of a fixing unit by separately controlling a developing operation and a fixing operation so that the fixing unit and the developing unit are disposed to be spaced-apart from each other by more than a certain range.

Additional aspects and advantages of the invention will be set forth in part in the description which follows and, in part, will be obvious from the description, or may be learned by practice of the invention.

In order to achieve the above and/or other aspects of the present invention, a driving apparatus for a double-side printable office machine includes a main body, a paper-supplying unit detachably mounted in a frame of the main body, a pickup/transport unit picking up and conveying a sheet of paper loaded in the paper-supplying unit in a paper transport direction, a developing unit forming a toner image on the sheet, a fixing unit heat-pressing the toner image formed on the sheet and fixing the toner image on the sheet as a visible image, a double-side printing unit having a paper return path through which the sheet having one side printed enters the developing unit to form another image on a reverse side of the sheet, and a transport part conveying the sheet through the paper return path, and a paper discharge unit discharging the sheet on which the visible image is fixed through the fixing unit.

The driving apparatus further includes a first driving part having a first driving motor and a first power transfer part transferring a power of the first driving motor to the pickup/transport unit, the developing unit, and a first roller of the transport part of the double-side printing unit to drive the pickup/transport unit, the developing unit, and the first roller of the transport part of the double-side printing unit, a second driving part having a second driving motor and a second power transfer part transferring a power of the second driving motor to the fixing unit, a second roller of the transport part of the double-side printing unit, and the paper discharge unit to drive the fixing unit, the second roller of the transport part of the double-side printing unit, and the paper discharge unit; and a controller controlling the first and second driving parts.

According to another aspect of the present invention, the first power transfer part of the first driving part includes at least one pickup roller gear connected to the first driving motor through at least one mid-connection gear, respectively, to drive at least one pickup roller, a photosensitive drum driving gear connected to the first driving motor through plural mid-connection gears to drive a photosensitive drum, and at least one first reverse-transport roller gear connected to the first driving motor through the plural mid-connection gears to drive the first roller of reverse-transport rollers of the transport part.

The second power transfer part of the second driving part includes a power transfer/cutoff part cutting off the power of the second driving motor to a fixing roller of the fixing unit and one of paper discharge rollers of the paper discharge unit when the second driving motor is driven in a direction for the sheet to re-enter the paper return path, and transferring the power of the second driving motor when the second driving motor is driven in a direction for the sheet to be discharged, a paper discharge roller gear connected to the second driving motor through the plural mid-connection gears to drive another one of the paper discharge rollers of the paper discharge unit in forward/reverse directions so that the sheet can be discharged or re-entered into the paper return path, and at least one second reverse-transport roller gear connected to the second driving motor through the plural mid-connection gears to drive the second roller of the reverse-transport rollers of the transport part.

The power transfer/cutoff part includes a latch gear disposed to be connected between the second driving motor, the paper discharge roller gear connected to the one of the paper discharge rollers, and the fixing roller gear.

The controller, in a double-side printing mode, controls the first driving motor of the first driving part to stop driving as a rear end of the sheet passes through the developing unit and reaches a certain position of the paper transport path and controls the first driving motor to be driven in the paper transport direction again when the sheet enters the paper return path and reaches a certain position of the paper return path. At this time, the controller obtains information on a stop position and a driving start position of the first driving motor by counting a period of time in which a movement of the sheet is detected by a register sensor disposed upstream in the paper transport direction of the developing unit and a paper sensor disposed downstream in the paper transport direction of the fixing unit.

Further, a position at which the first driving motor starts to drive, is set so that a first period of time needed for a process initialization of the developing unit is shorter than a second period of time during which a front end of the sheet in a paper progress direction on the paper return path moves to the developing unit after the start of the driving of the first driving motor.

Further, the controller, in the double-side printing mode, controls the first driving motor to completely stop when the rear end of the sheet exits the developing unit when the sheet is a last printing sheet.

Further, the second driving motor is, in the double-side printing mode, controlled to be forward rotated after stopping for a certain period of time or immediately after the sheet exits the second roller of the transport part driven by the second driving motor after entering the paper return path.

According to another aspect of the present invention, a driving method for a double-side printable office machine includes a main body, a paper-supplying unit detachably mounted in the frame of the main body, a pickup/transport unit picking up and conveying sheets of paper loaded in the paper-supplying unit, a developing unit forming a toner image on a sheet, a fixing unit heat-pressing the toner image formed on the sheet and fixing the toner image as a visible image, a double-side printing unit having a paper return path through which the sheet having one side printed enters the developing unit to form another image on a reverse side of the sheet, and having a transport part conveying the sheet through the paper return path, a paper discharge unit discharging the sheet on which the visible image is fixed, through the fixing unit, a first driving part having a first driving motor and a first power transfer part transferring power of the first driving motor to the pickup/transport unit, the developing unit, and a first roller of the transport part of the double-side printing unit to drive the pickup/transport unit, the developing unit, and the first roller of the transport part of the double-side printing unit, a second driving part having a second driving motor and a second power transfer part transferring power of the second driving motor to the fixing unit, a second roller of the transport part of the double-side printing unit, and the paper discharge unit to drive the fixing unit, the second roller of the transport part of the double-side printing unit, and the paper discharge unit, and a controller controlling the first and second driving parts.

The driving method further includes determining whether a mode is a double-side printing mode, stopping the first driving motor of the first driving part when a rear end of the sheet passes through the developing unit and reaches a certain position of a paper transport path in the double-side printing mode, driving the second driving motor of the second driving part in a direction conveying the sheet into a paper return path in the double-side printing mode, and driving the second driving motor in a direction discharging the sheet upon determining that the mode is not the double-side printing mode, when the rear end of the sheet swings in a direction of the paper return path, cutting off power transferred to one of paper discharge rollers of the paper discharge unit and the fixing unit from the second driving motor when the second driving motor is driven in a direction for the sheet to enter the paper return part, and driving the first driving motor of the first driving part in the paper transport direction again as the sheet enters the paper return path and reaches a certain position of the paper return path.

According to another aspect of the present invention, the stopping of the first driving motor includes obtaining information on a stop position of the first driving motor by counting a period of time in which a movement of the sheet is detected by a register sensor disposed upstream in the paper transport direction of the developing unit.

The driving of the first driving motor again includes obtaining information on a driving start position of the first driving motor by counting a period of time during which the movement of the sheet is detected by a paper sensor disposed downstream in the paper transport direction of the fixing unit.

According to another aspect of the present invention, the driving method includes setting a position at which the first driving motor starts driving so that a first period of time needed for a process initialization of the developing unit is shorter than a second period of time during which the front end of the sheet in the paper progress direction on the paper return path moves to the developing unit after starting the driving of the first driving motor.

The method further includes completely stopping the first driving motor when the rear end of the sheet exits the developing unit when the sheet is a last printing sheet.

Further, the method further includes driving the second driving motor in a direction for the sheet to be discharged after a stop for a certain period of time as the sheet is out of the second roller of the transport part driven by the second driving motor after the sheet enters the paper return path in the double-side printing mode. Alternatively, the method further includes driving the second driving motor in a direction discharging the sheet immediately when the sheet exits the second roller of the transport part driven by the second driving motor after the sheet enters the paper return path upon the double-side printing mode.

According to yet another aspect of the present invention, a driving method for a double-side printable office machine includes a paper-loading unit detachably mounted in the frame of a main body, a pickup/transport unit picking up and conveying sheets of paper loaded in the paper-loading unit in a paper transport path, a developing unit forming a toner image on a sheet, a fixing unit heat-pressing the toner image formed on a sheet and fixing the toner image as a visible image, a double-side printing unit having a paper return path through which the sheet having one side printed enters to the developing unit to form another image on a reverse side of the sheet, and having a transport part conveying the sheet through the paper return path, a paper discharge unit discharging the sheet on which the visible image is fixed through the fixing unit, a first driving part having a first driving motor and a first power transfer part transferring a power of the first driving motor to the pickup/transport unit, the developing unit, fixing unit, one of paper discharge rollers of the paper discharge-unit, and the transport part of the double-side printing unit to drive a first driving motor, the pickup/transport unit, the developing unit, the fixing unit, the portion of the paper discharge unit, and the transport part of the double-side printing unit, a second driving part having a second driving motor and a second power transfer part transferring a power of the second driving motor to another one of the paper discharge rollers of the paper discharge unit to drive the another one of the paper discharge rollers of the paper discharge unit, and a controller controlling the first and second driving parts.

The driving method further includes determining whether a mode is a double-side printing mode, stopping the first driving motor of the first driving part when a rear end of the sheet passes through the developing unit and reaches a certain position of the paper transport path when the mode is the double-side printing mode, driving the second driving motor of the second driving part in a direction conveying the sheet into the paper return path upon the double-side printing mode, and driving the second driving motor in a direction discharging the sheet upon determining that the mode is not the double-side printing mode, when the rear end of the sheet swings in a direction of the paper return path, and driving, upon determining that the mode is the double-side printing mode, the first driving motor of the first driving part in the paper transport direction again as the sheet enters the paper return path and reaches a certain position of the paper return path.

According to another aspect of the present invention, the stopping of the first driving motor includes obtaining information on a stop position of the first driving motor by counting a period of time in which a movement of the sheet is detected by a paper sensor disposed downstream in the paper transport direction of the fixing unit.

The driving of the first driving motor again includes obtaining information on a driving start position of the first driving motor by counting a period of time during which the movement of the sheet is detected by a paper sensor disposed downstream in the paper transport direction of the fixing unit.

Further, the driving of the first driving motor in the paper transport direction again includes setting a position at which the first driving motor starts driving, so that a first period of time needed for a process initialization of the developing unit is shorter than a second period of time during which a front end of the sheet in a paper progress direction on the paper return path moves to the developing unit after starting the driving of the first driving motor.

The method further includes completely stopping the first driving motor when a certain period of time lapses after a rear end of the sheet exits the fixing unit when the sheet is a last printing sheet.

Further, the method further includes driving the second driving motor in a direction for the sheet to be discharged after a stop for a certain period of time as the sheet is out of the another one of the paper discharge rollers of the paper discharge unit driven by the second driving motor after the sheet enters the paper return path in the double-side printing mode. Alternatively, the method further includes driving the second driving motor in a direction discharging the sheet immediately as the sheet is out of the another one of the paper discharge rollers of the paper discharge unit driven by the second driving motor after the sheet enters the paper return path in the double-side printing mode.

BRIEF DESCRIPTION OF THE DRAWINGS

These and other aspects and advantages of the invention will become apparent and more readily appreciated from the following description of the preferred embodiment, taken in conjunction with the accompanying drawings of which.

DETAILED DESCRIPTION OF THE PREFERRED EMBODIMENTS

Figure 1:
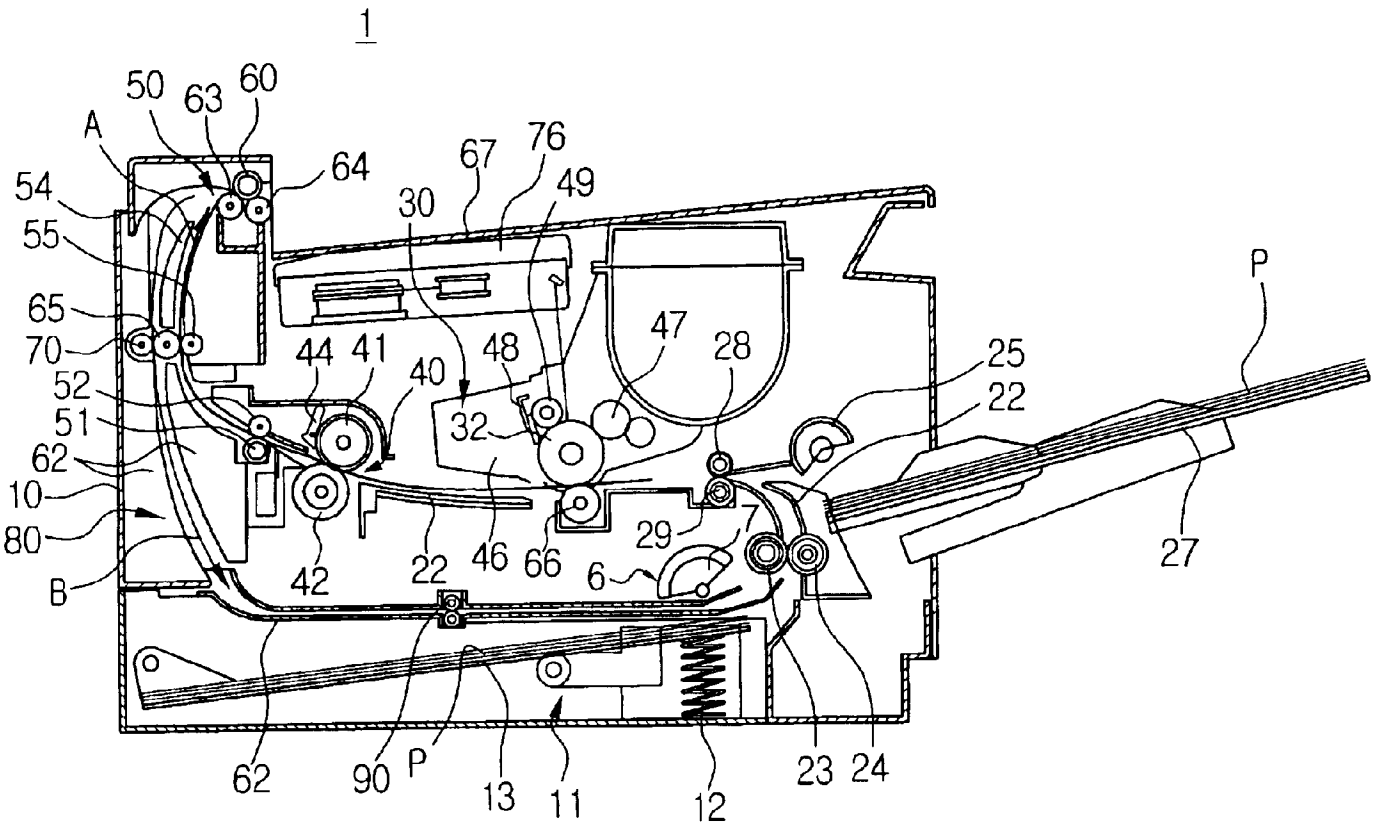
FIG. 1 (PRIOR ART)
FIG. 1 is a cross-sectioned view schematically showing a conventional double-side printing laser printer.

Reference will now be made in detail to the present preferred embodiment of the present invention, examples of which are illustrated in the accompanying drawings, wherein like reference numerals refer to the like elements throughout. The embodiment is described in order to explain the present invention by referring to the figures.

Hereinafter, a driving apparatus 100 and a method in a double-side printable office machine are described in detail according to an embodiment of the present invention with reference to FIGS. 1 and 3. In the description, the same constituents as in FIG. 1 are assigned the same reference numerals for descriptions.

Figure 3:
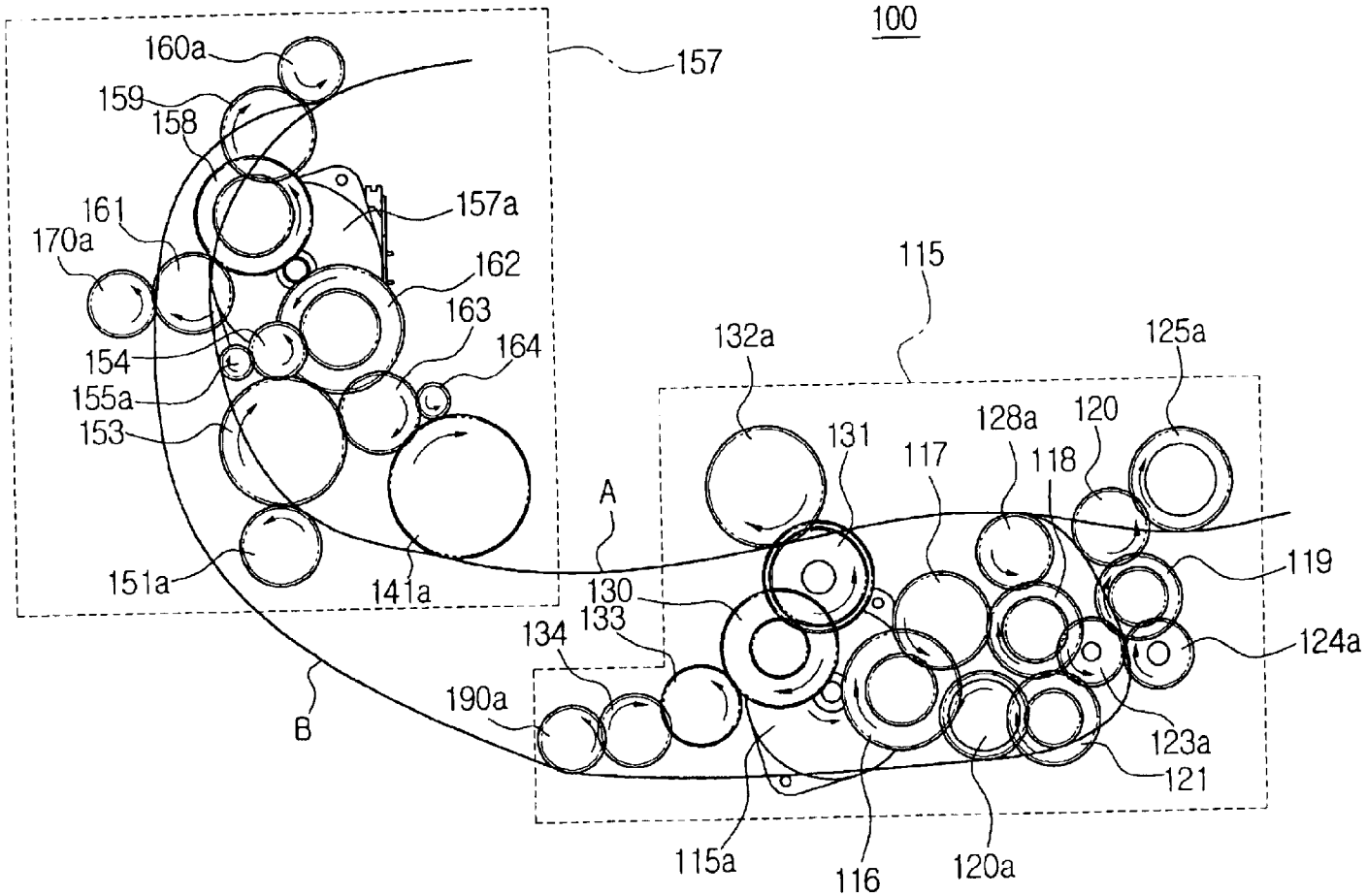
FIG. 3 is a cross-sectioned view schematically showing a driving apparatus of a double-side printing laser printer according to an embodiment of the present invention.

The driving apparatus 100 of the double-side printing laser printer is schematically shown in FIG. 3.

The double-side printing laser printer to which the driving apparatus 100 is applied as a double-side printing laser printer 1 shown in FIG. 1, includes a paper-supplying cassette 11 detachably mounted to a frame 10 of a main body of the double-side printing laser printer 1, a pickup/transport unit 6 picking up and transporting a sheet of paper P loaded in the paper-supplying cassette 11, a developing unit 30 forming a toner image on the sheet P, a fixing unit 40 heat-pressing the toner image formed on the sheet P to fix the toner image on the sheet P as a visible image, a paper discharge unit 50 discharging the sheet P on which the visible toner image is fixed by the fixing unit 40, and a double-side printing unit 80 re-feeding a one-side printed sheet P through the fixing unit 40 to the developing unit 30 in order to print the other side of the sheet P. Since the constituents of the double-side printing printer are the same as the double-side printing laser printer 1 shown in FIG. 1, a detailed description will be omitted.

A driving apparatus 100 of the double-side printing laser printer includes a first driving part 115 driving a second reverse-transport roller 90 of transport parts 70 and 90 of the double-side printing unit 80, the pickup/transport unit 6, and the developing unit 30, and a second driving part 157 driving the paper discharge unit 50 and a first reverse-transport roller 90 of the transport parts 70 and 90 of the double-side printing unit 80, and a controller controlling the first and second driving parts 115 and 157.

The first driving part 115 has a first driving motor 115*a* rotating in one direction and a first power transfer part transferring a driving power of the first driving motor 115*a* to the pickup/transport unit 6, the developing unit 30, and the second reverse-transport roller 90 of the double-side printing unit 80 to drive the pickup/transport unit 6, the developing unit 30, and the second reverse-transport roller 90 of the double-side printing unit 80.

The first power transfer part has a first pickup roller gear 120*a* connected to the first driving motor 115*a* through a first satellite gear 116 to drive a pickup roller 7 of FIG. 1, a photosensitive drum driving gear 132*a* connected to the first driving motor 115*a* through a second satellite gear 130 and a photosensitive drum idle gear 131 to drive a photosensitive drum 32, and a second reverse-transport roller gear 190*a* connected to the second satellite gear 130 through first and second reverse-transport idle gears 133 and 134 to drive the second reverse-transport roller 90.

The first pickup roller gear 120*a* is coupled to a transport roller gear 123*a* through a transport roller idle gear 121 to drive a transport roller 23 of FIG. 1, and the transport roller gear 123*a* is coupled to a return roller gear 124*a* to drive a reverse roller 24 of FIG. 1.

The transport roller gear 123*a* is coupled to a second pickup roller gear 125*a* through first and second pickup idle gears 119 and 120 to drive a second pickup roller 25 of FIG. 1.

Figure 2:
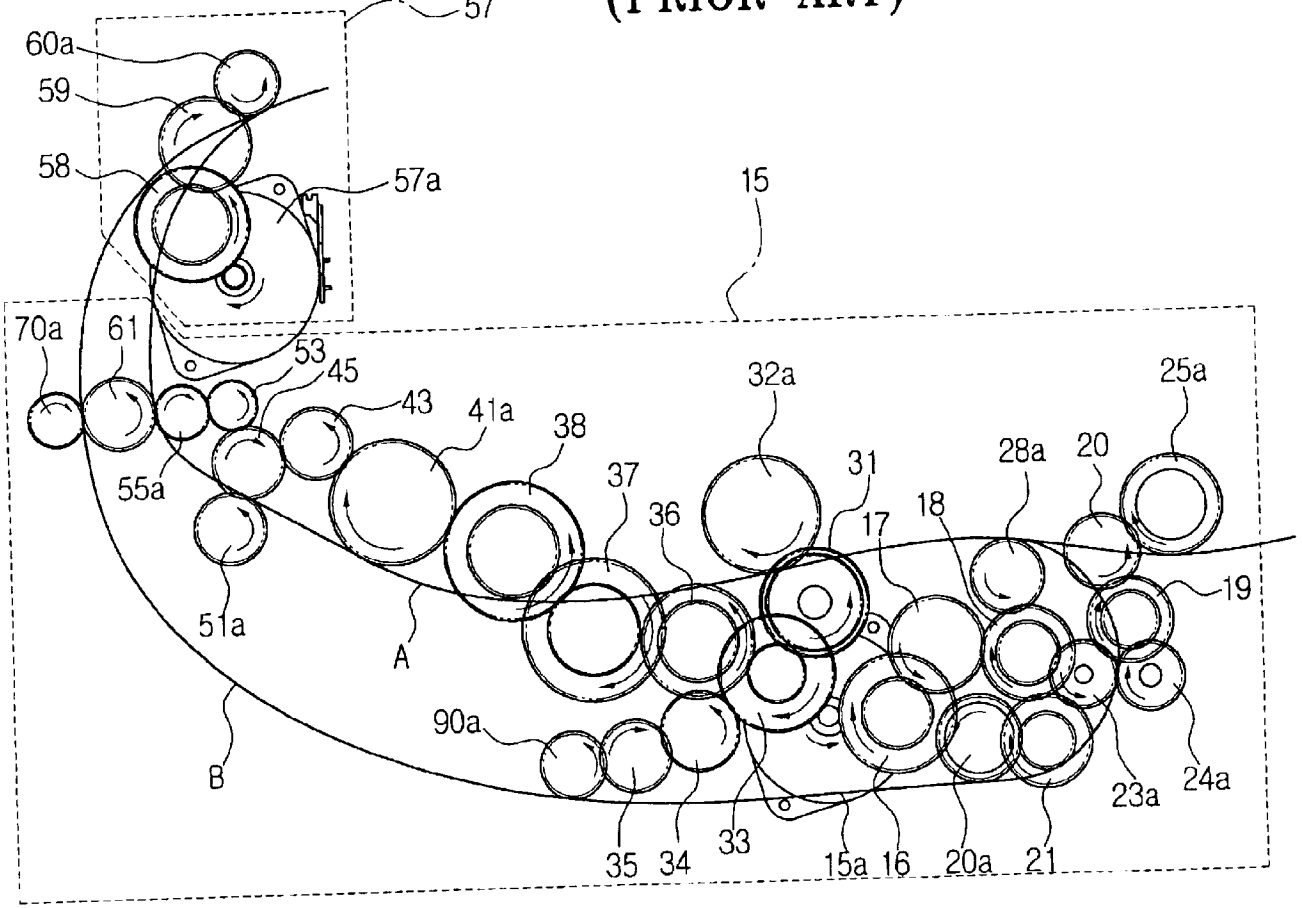
FIG.2 (PRIOR ART)
FIG. 2 is a cross-sectioned view schematically showing a driving apparatus of the double-side printing laser printer of FIG. 1.

Further, the first satellite gear 116 is coupled to a register roller gear 128*a* through the register idle gears 117 and 118 to drive a register roller 28 of FIG. 2.

The second driving part 157 has a second driving motor 157*a* rotating in both directions and a second power transfer part transferring a driving power of the second driving motor 157*a* to a fixing roller 41 of the fixing unit 40, the first reverse-transport roller 70 of the transport parts 70 and 90 of the double-side printing unit 80 and to first, second, and third paper discharge rollers 51, 55, and 60 of the paper discharge unit 50 to drive the fixing roller 41 of the fixing unit 40, the first reverse-transport roller 70 of the transport parts of the double-side printing unit 80, and the first, second, and third paper discharge rollers 51, 55, and 60 of the paper discharge unit 50 as shown in FIGS. 1 and 3.

The second power transfer part has a power transfer/cutoff part 162 cutting off a power of the second driving motor 157*a* to the fixing roller 41 and the first and second paper discharge rollers 51 and 55, from the second driving motor 157*a* when the second driving motor 157*a* is driven in a direction of returning the sheet P to the paper return path B, and transferring the power of the second driving motor 157*a* when the second driving motor 157*a* is driven in a direction of discharging the sheet P, to a third paper discharge roller gear 160*a* coupled to the second driving motor 157*a* through a third satellite gear 158 and the first paper discharge idle gear 159, and a first reverse-transport roller gear 170*a* connected to the third satellite gear 158 through a first reverse-transport idle gear 161 to drive the first reverse-transport roller 70.

The power transfer/cutoff part 162 is constructed with a latch gear meshed with the second driving motor 157*a* to transfer the power when the second driving motor 157*a* is clockwise rotated and to cut off the power when the second driving motor 157*a* is counterclockwise rotated as shown in FIG. 3. The latch gear of the power transfer/cutoff part 162 is meshed with a first paper discharge roller gear 151*a* through a second paper discharge roller idle gear 153, meshed with a second paper discharge roller gear 155*a* through second and third paper discharge idle gears 153 and 154, and meshed with a fixing roller gear 141*a* through first and second fixing roller idle gears 163 and 164.

The controller controls the first driving motor 115*a* of the first driving part 115 to stop driving when a rear end of the sheet P passes through the developing unit 30 and reaches a certain position of the paper transport path A in a double-side printing mode, and controls the first driving motor 115*a* of the first driving part 115 to start to drive in a paper transport direction when the rear end of the sheet P enters the paper return path B and reaches another certain position of the paper return path B. At this time, the controller obtains information on a stop position and a driving-start position of the first driving motor 115*a* by counting a period of time which the sheet P is detected by a register sensor disposed upstream in the paper transport direction of the developing unit 30 and a paper sensor 44 disposed downstream in the paper transport direction of the fixing unit 40.

Further, the driving start position of the first driving motor 115*a* is set for a first period of time needed for the process initialization of the developing unit 30 to be shorter than a second period of time needed for a front end of the sheet P in the paper progress direction on the paper return path B to move to a nip between the photosensitive drum 32 of the developing unit 30 and the transfer roller 66 after the start of the driving of the first driving motor 115*a*.

Further, the controller, in the double-side printing mode, controls the first driving motor 115*a* to completely stop as the rear end of the last printing sheet P exits the developing unit 30.

Further, the controller controls the second driving motor 157*a* to forward rotate after a stop for a third period of time or to start the forward rotation immediately as the sheet P exits the third paper discharge roller 60 of the paper discharge unit 50 connected to the second driving motor 157*a* after entering the paper return path B by a reverse rotation of the third paper discharge roller 60.

As described above, the driving apparatus 100 controls paper pickup/supply and developing operations separately from paper return operations in the double-side printing mode in particular, so that a waste toner amount increased by no-load rotations of the developing unit 30 can be prevented, and noise and wear and tear of the developing unit 30 can be reduced.

Further, the driving apparatus 100 controls the fixing unit 40 and the developing unit 30 by the separate driving parts 115 and 157, so that the fixing unit 40 and the developing unit 30 can be disposed spaced-apart from each other by more than a certain range. Accordingly, damage to the developing unit 30 occurring due to fixing heat of the fixing unit can be prevented during a fixing operation of the fixing unit 40.

The operations of the driving apparatus 100 for the double-side printable laser printer as structured above, will be described in detail with reference to FIGS. 1 and 3.

First, assuming that the sheets P are automatically fed, the first driving motor 115*a* is driven in one direction, for example, in a counterclockwise direction based on a command of the controller. Therefore, the first satellite gear 116 coupled to the first driving motor 115*a* is rotated in a clockwise direction.

As the first satellite gear 116 is rotated in the clockwise direction, the first pickup roller gear 120*a* meshed with the first satellite gear 116 is counterclockwise rotated. Therefore, the first pickup roller 7 coaxially formed with the first pickup roller gear 120*a* is counterclockwise rotated in a state of close contact with the sheet P loaded in the paper-supplying cassette 11. As a result, one sheet, that is, the first sheet P is picked up by the first pickup roller 7 and transported between the transport roller 23 and the reverse roller 24.

The first sheet P transported between the transport roller 23 and the reverse roller 24 is conveyed to the register roller 28 by a counterclockwise rotation force of the transport roller gear 123*a* coupled to the first pickup roller gear 120*a* through the transport roller idle gear 121.

A front end of the first sheet P conveyed to the register roller 28 is pushed and aligned by the nip between the register roller 28 and a backup roller 29.

Thereafter, when the first sheet P passes through and continues to move through the nip between the register roller 23 and the backup roller 29 by a rotation force of the register roller gear 128*a*, the front end of the first sheet P pushes a register sensor (not shown) disposed between the register roller 28 and the transfer roller 66. As a result, the register sensor outputs a sheet sensing signal to the controller.

The controller counts a period of time when the sheet P moves from the register sensor to the transfer roller 66 based on the sheet sensing signal, transports the first sheet P for a predetermined time taken for the sheet P to arrive at a printing start position, and operates the developing unit 30 and the transfer roller 66.

While the first sheet P moves toward the developing unit 30, the LSU 76 is electrically charged by corona discharges or the like based on an image signal, and scans with a laser beam a surface of the photosensitive drum 32 clockwise rotating by the first driving motor 115*a* through the photosensitive drum gear 132*a*, the second satellite gear 130, and the photosensitive drum idle gear 131 to form an electrostatic latent image, and toner particles are attracted to the electrostatic latent image formed on the photosensitive drum 32 by the developing roller 47 rotating opposite to the photosensitive drum 32 so as to develop the electrostatic latent image in the toner image of a visible form.

Thereafter, when the first sheet P continuously passes under the photosensitive drum 32, the toner image formed on the photosensitive drum 32 is transferred on one side of the first sheet P by a pressure between the photosensitive drum 32 and the transfer roller 66 and a high voltage having polarity opposite to the toner and applied to the transfer roller 66.

While the toner image is being transferred to the first sheet P, the controller determines whether a current printing mode is a single-side printing mode or a double-side printing mode.

While the current printing mode is determined as the single-side printing mode, the controller determines whether the first sheet P being currently printed is a last printing sheet. Upon determining that the first sheet P is the last printing sheet, the controller may stop the driving of the first driving motor 115*a*, and, accordingly, the developing unit 30 stops as a period of time lapses after the toner image is completely transferred on the one side of the first sheet P, that is, after a lapse of a first time (t1) during which the rear end of the first sheet P passes through the register sensor and reaches the photosensitive drum 32 of the developing unit 30 to process the transfer of the toner image and another lapse of a second time (t2) during which the rear end of the sheet P reaches a position between the developing unit 30 and the fixing unit 40 or a certain position downstream in the paper transport direction of the fixing unit 40.

Further, at this time, when the first sheet P is not the last printing sheet as a result of the determination, the controller controls the first driving part 15 to pick up a next sheet, e.g., a second sheet, without stopping the driving of the first driving motor 115*a* by driving the first pickup roller 7 through the first pickup roller gear 120*a* with an appropriate interval in consideration of a front end margin of the second sheet P, and repeats a developing process described above.

Here, assuming that the current printing mode is the double-side printing mode, the controller determined the double-side printing mode and stops the first driving motor 115*a* as the first and second times t1 and t2 lapse after the rear end of the first sheet P operates the register sensor regardless of whether the first sheet P being currently printed is the last printing sheet.

In the meantime, as the front end of the first sheet P reaches the fixing unit 40, that is, after a third time t3 lapses during which the front end of the first sheet P passes through the register sensor and reaches the fixing unit 40, the controller controls the second driving motor 157*a* to be driven in a first direction, for example, clockwise as shown in FIG. 3. Accordingly, the toner image transferred on the one side of the first sheet P is fixed as a printed image by the heat of the fixing roller 41 driven by the fixing roller gear 141*a* meshed with the latch gear of the power transfer/cutoff part 162 and the first and second fixing roller idle gears 163 and 164 and by the pressure of the fixing backup roller 42.

As stated above, the first sheet P having the one side of which a desired image is printed, is continuously conveyed by a rotation force of the fixing backup roller 42, pushes and passes through the paper sensor 44. Accordingly, the paper sensor 44 fixed to a rotation axis connected to a limit switch or a solenoid is turned on to an "on" state while being in contact with the front end of the first paper P, and sends an 'on' signal to the controller.

After the front end of the first sheet P operates the paper sensor 44, the first sheet P moves toward the third paper discharge roller 60 by the first and second paper discharge rollers 51 and 55 driven by the first and second paper discharge roller gears 151*a* and 155*a* connected through the latch gear of the power transfer/cutoff part 162, the second paper discharge roller idle gear 153 and/or the third paper discharge roller idle gear 154, and the third paper discharge roller 60 continuously conveys the first sheet P toward the paper discharge cassette 67 by the third paper discharge roller gear 160*a* connected to the second driving motor 157*a* through the third satellite gear 158 and the first paper discharge roller idle gear 159.

As stated above, when the first sheet P is continuously conveyed so that the rear end of the first sheet P passes through the paper sensor 44, the paper sensor 44 pushed in the 'on' state by the first sheet P is again rotated to the original position and sends an 'off' signal to the controller.

As stated above, as a predetermined period of time lapses after the paper sensor 44 is turned off, that is, as the rear end of the first sheet P passes through the paper transport direction switching guide 54 and swings into the paper transport path B due to a stiffness of the sheet, the controller controls the second driving motor 157*a* to be driven in a second direction, for example, to be counterclockwise (reversely) driven.

As the second driving motor 157*a* is counterclockwise driven, the third paper discharge roller 60 is clockwise rotated by the third paper discharge roller gear 160*a*. Accordingly, the first sheet P enters the paper return path B and is conveyed toward the first reverse-transport roller 70.

At this time, the second driving motor 157*a* is driven at a speed 1.5~2 times higher than that of the first driving motor 115*a* in order to increase a double-side printing efficiency. Further, at this time, the latch gear cutting off the power transfer is installed between the fixing roller 41, the first and second paper discharge rollers 51 and 55 and the second driving motor 157*a* to prevent an overload from being transferred to the fixing unit 40 as the driving speed of the second driving motor 157*a* increases, so that a counter-clockwise rotation force of the second driving motor 157*a* is not transferred to the fixing roller 41 and the first and second paper discharge rollers 51 and 55.

After the first sheet P reaches the first reverse-transport roller 70, the first sheet P is conveyed toward the second reverse-transport roller 90 through the reverse-transport guide 62 by the first reverse-transport roller 70 clockwise rotating together with the first reverse-transport roller gear 170*a* connected to the second driving motor 157*a* through the third satellite gear 158 and the first reverse-transport idle gear 161.

After the rear end of the first sheet P in the paper progress (forward) direction on the paper return path B is out of the first reverse-transport roller 70, the controller controls the second driving motor 157*a* to remain stationary without driving until the other side of the first sheet P enters the fixing unit 40 after being completely developed. Alternatively, at this time, the second driving motor 157*a* may be directly driven to be clockwise rotated.

Thereafter, when the front end of the first sheet P in the paper progress direction passes near the second reverse-transport roller 90, the controller controls the first driving motor 115*a* to be counterclockwise driven, to thereby drive the second reverse-transport roller 90.

At this time, a start timing or position at which the first driving motor 115*a* is driven is set for a first period of time needed for the process initialization of the developing unit 30 to be shorter than a second period of time during which the front end of the first sheet P in the paper progress direction moves to the developing unit 30 after the driving of the first driving motor 115*a* starts.

As stated above, when the first driving motor 115*a* starts to be counterclockwise driven, the second reverse-transport roller 90 is counterclockwise rotated by the second reverse-transport roller gear 190*a* connected to the first driving motor 115*a* through the second satellite gear 130 and the first and second reverse-transport roller idle gears 133 and 134, thereby conveying the first sheet P toward the transport roller 23 and the reverse roller 24.

The first sheet P conveyed toward the transport roller 23 and the reverse roller 24, in a manner described above, moves to the developing unit 30 by the first driving part 115 to form the toner image on the other (reverse) side of the first sheet P.

While the toner image is formed on the reverse side of the first sheet P, the controller determines whether the currently printing sheet is the last printing sheet. If the currently printing sheet is the last printing sheet as a result of the determination, as a certain period of time lapses after the toner image is completely transferred on the reverse side of the first sheet P, that is, as the first and second times t1 and t2 lapse after the rear end of the first sheet P on the paper transport path A passes through the register sensor, the controller stops the driving of the first driving motor 115*a* to stop the developing unit 30. Further, as the third time t3 lapses after the front end of the first sheet P passes through the register sensor, the controller controls the second driving motor 157*a* to be clockwise driven. Accordingly, the toner image transferred on the reverse side of the first sheet P is fixed as a printed image by the heat of the fixing roller 41 and the pressure of the fixing roller 42, and the first sheet P is discharged to the paper discharge cassette 67 through the first, second, and third paper discharge rollers 51, 55, and 60 of the paper discharge unit 50 driven in the paper discharge direction by the second driving motor 157*a*.

Further, at this time, when the currently printing sheet is not the last sheet as the result of the determination, the controller does not stop the driving of the first driving motor 115*a*, but drives the first pickup roller 7 with an appropriate interval in consideration of the front end margin of a next printing sheet, that is, the second sheet P to pick up the second sheet P, and repeats the developing process described above.

Hereinafter, a driving method of the driving apparatus for the double-side printable laser printer is shown in FIGS. 1 and 2.

The double-side printable laser printer and the driving apparatus to which the driving method is applied are the same as the conventional double-side printable printer 1 and the driving apparatus as shown in FIGS. 1 and 2. Accordingly, a detailed description therefor will be omitted.

The driving method of the double-side printable laser printer is described in detail as below with reference to FIGS. 1 and 2.

First, as in the conventional double-side printable laser printer 1, the first sheet P is picked up and conveyed by the first pickup roller 7 and the transport roller 23, developed and fixed by the developing unit 30 and the fixing unit 40, and pushes and passes through the paper sensor 44 disposed downstream in the paper transport direction of the fixing unit 40.

Accordingly, the paper sensor 44 fixed to a rotation axle connected to a limit switch or a solenoid is turned 'on' when being in contact with the front end of the first sheet P, and sends an 'on' signal to the controller.

After the front end of the first sheet P operates the paper sensor 44, the front end of the first sheet P continuously moves by the first and second paper discharge rollers 51 and 55 driven by the first and second paper discharge roller gears 51*a* and 55*a* associated with the first driving motor 15*a* to reach a specified position between the second paper discharge roller 55 and the third paper discharge roller 60, and the controller clockwise drives the second driving motor 57*a*. Accordingly, the first sheet P is conveyed toward the paper discharge cassette 67 by the third paper discharge roller gear 60*a* connected to the second driving motor 57*a* through the first and second mid-connection gears 58 and 59.

As stated above, when the first sheet P is conveyed and the rear end of the first sheet P passes through the paper sensor 44, the paper sensor 44 in the 'on' state by the first sheet P is rotated to return to its original position, and sends an 'off' signal to the controller.

At this time, the controller determines whether the currently printing mode is the single-side mode or the double-side mode.

When it is determined that the currently printing mode is the single-side mode as a result of the determination, the controller determines whether the first sheet P being currently printed is the last printing sheet. When the currently printing sheet is the last sheet as a result of the determination, as a certain period of time lapses after a toner image is completely transferred on one side of the first sheet P, that is, as a period of time lapses during which the rear end of the first sheet P reaches a position between the second paper discharge roller 55 and the third paper discharge roller 60 after the paper sensor 44 is turned 'off', the controller controls the first driving motor 15*a* to stop rotating. Accordingly, the developing unit 30 stops, and the second driving motor 57*a* continuously drives the third paper discharge roller 60 in the clockwise direction to discharge the first sheet P toward the paper discharge cassette 67.

Further, at this time, when the currently printing sheet is not the last sheet as a result of the determination, the controller does not stop the driving of the first driving motor 15*a*, but drives the first pickup roller 7 with an appropriate interval in consideration of the front end margin of a next printing sheet, that is, the second sheet P to pick up the second sheet P, and repeats the developing process described above.

Herein, assuming that the current printing mode is the double-side printing mode, the controller determines the double-side printing mode, and stops the first driving motor 15*a* as a period of time lapses during which the rear end of the first sheet P reaches a position between the second paper discharge roller 55 and the third paper discharge roller 60 after the rear end of the first sheet P turns 'off' the paper sensor 44 regardless of whether the first sheet P being currently printed is the last printing sheet.

Thereafter, when the rear end of the first sheet P passes through the paper transport direction switching guide 54 and swings into the paper return path B due to the stiffness of the sheet itself, the controller controls the second motor 57*a* to be driven from forward to reverse, for example, from clockwise to counterclockwise.

As the second motor 57*a* is counterclockwise driven, the third paper discharge roller 60 is clockwise rotated by the third paper discharge roller gear 60*a*. Accordingly, the first sheet P is not discharged to the paper discharge cassette 67, but conveyed into the paper return path B and transported toward the first reverse-transport roller 70.

At this time, the second driving motor 57*a* is driven at a speed 1.5~2 times higher than the driving speed of the first driving motor 15*a* in order to increase the double-side printing efficiency.

Thereafter, if the rear end of the first sheet P in the paper progress direction on the paper return path B is out of the third paper discharge roller 60, the controller controls the second driving motor 57*a* to remain stationary instead of being driven till the reverse side of the first sheet P is completely developed and reaches a certain position between the second paper discharge roller 55 and the third paper discharge roller 60. Alternatively, the second driving motor 57*a* can be directly driven to be clockwise rotated.

Further, as the front end of the first sheet P entered in the paper return path B moves closer to the first reverse-transport roller 70, the controller controls the first driving motor 15*a* to be counterclockwise driven again to drive the first reverse-transport roller 70.

At this time, alternatively, the first reverse-transport roller 70, in order to maximize the effect of the present invention, can be constructed with an idle roller not receiving power from the first driving motor 15*a* to perform only a function of arranging sheets. At this time, in order to drive the second reverse-transport roller 90, the timing when the first driving motor 15*a* starts to drive the second reverse-transport roller 90, is set for a period of time needed for the initialization process of the developing unit 30 to be shorter than a period of time which the front end of the first sheet P in the paper progress direction on the paper return path B moves to the developing unit 30 after the start of the driving of the first driving motor 15*a*.

As stated above, when the first driving motor 15*a* is counterclockwise driven again, the first reverse-transport roller 70 is clockwise rotated by the first reverse-transport roller gear 70*a* associated with the first driving motor 15*a*, and conveys the first sheet P toward the second reverse-transport roller 90 and the transport roller 23.

The first sheet P conveyed toward the transport roller 23 moves to the developing unit 30 along the paper transport guide 22 constructing the paper transport path A by the first driving part 15 in the method as described above to form an image on the reverse side of the sheet, and after fixing the image by the fixing unit 40, operates the paper sensor 44.

After the front end of the first sheet P operates the paper sensor 44 and reaches a specific position between the second paper discharge roller 55 and the third paper discharge roller 60, the controller drives the second driving motor 57*a* again and discharges the first sheet P to the paper discharge cassette 67 through the third paper discharge roller 60.

Further, at this time, the controller decides whether the first sheet P being currently printed is the last printing sheet.

When the sheet is the last printing sheet as a result of the decision, as a certain period of time lapses which the rear end of the first sheet P reaches a position between the second paper discharge roller 55 and the third paper discharge roller 60 after the rear end of the first sheet P on the paper transport path A passes through the paper sensor 44 and the paper sensor 44 is turned 'off', the controller stops the driving of the first driving motor 15*a* to completely stop the developing unit 30.

Further, at this time, when the sheet is not the last sheet as a result of the decision, the controller does not stop the driving of the first driving motor 15*a*, but drives the first pickup roller 7 to pick up the second sheet P with an appropriate interval in consideration of the front end margin of a next printing sheet, that is, the second sheet P, and repeats the developing process described above.

As stated above, the driving apparatus and method in a double-side printable laser printer of the present invention can reduce a size and a waste toner amount of the developing unit to decrease a manufacturing cost and reduce noise and wear and tear of the developing unit to enhance a lifespan and reliability of products by controlling the paper pickup/supply and developing operations to be performed separately from the operation of fixing, discharging, and returning sheets in particular for double-side printings.

Further, the driving apparatus and method in a laser printer can prevent damage to the developing unit occurring due to fixing heat by separately controlling the developing operation and the fixing operation in order for the fixing unit and the developing unit to be disposed to be spaced-apart from each other by less than a certain range.

Although the preferred embodiment of the present invention has been described, it will be understood by those skilled in the art that the present invention should not be limited to the described preferred embodiment, but various changes and modifications can be made within the spirit and scope of the present invention as defined by the appended claims and their equivalents.

What is claimed is:

1. A driving apparatus for a double-side printable machine having a paper-supplying unit detachably mounted in the frame of a main body, a pickup/transport unit picking up and conveying a sheet of paper loaded in the paper-supplying unit along a paper transport path in a paper transport direction, a developing unit having a photosensitive drum and forming a toner image on the sheet, a fixing unit heat-pressing the toner Image formed on the sheet and fixing the toner image as a visible image, a double-side printing unit having a paper return path through which the sheet having one side printed enters the developing unit to form another image on a reverse side of the sheet, and having a transport part conveying the sheet through the paper return path and having a first roller and a second roller, and a paper discharge unit discharging the sheet on which the visible image is fixed through the fixing unit, comprising:

a first driving part having a first driving motor and a first power transfer part transferring a first power of the first driving motor to the pickup/transport unit, the developing unit, and the first roller of the transport part of the double-side printing unit to drive the pickup/transport unit, the developing unit, and the first roller of the transport part of the double-side printing unit;

a second driving part having a second driving motor and a second power transfer part transferring a second power of the second driving motor to the fixing unit, the second roller of the transport part of the double-side printing unit, and the paper discharge unit to drive the fixing unit, the second roller of the transport part of the double-side printing unit, and the paper discharge unit; and a controller controlling the first and second driving parts.

2. The driving apparatus as claimed in claim 1, wherein the first power transfer part of the first driving part comprises:

at least one pickup roller gear respectively connected to the first driving motor to drive at least one pickup roller;

a photosensitive drum driving gear connected to the first driving motor to drive the photosensitive drum; and at least one first reverse-transport roller gear connected to the first driving motor to drive the first roller of the transport part of the double-side printing unit.

3. The driving apparatus as claimed in claim 2, wherein:

the fixing unit comprises a fixing roller;

the paper discharge unit comprises paper discharge rollers; and the second power transfer part of the second driving part comprises:

a power transfer/cutoff part cutting off the second power of the second driving motor to the fixing roller of the fixing unit and one of the paper discharge rollers of the paper discharge unit when the second driving motor is driven in a direction for the sheet to re-enter the paper return path, and transferring the second power to the transport part when the second driving motor is driven in a direction for the sheet to be discharged, a paper discharge roller gear connected to the second driving motor to drive another one of the paper discharge rollers of the paper discharge unit in forward/reverse directions so that the sheet can be discharged or re-entered into the paper return path, and at least one second reverse-transport roller gear connected to the second driving motor to drive the second roller of the transport part of the double-side printing unit.

4. The driving apparatus as claimed in claim 3, wherein the power transfer/cutoff part comprises:

a latch gear disposed to connect the second driving motor to the fixing roller and the one of the paper discharge rollers.

5. The driving apparatus as claimed in claim 4, wherein the controller, in a double-side printing mode, controls the first driving motor of the first driving part to stop as a rear end of the sheet passes through the developing unit and reaches a position of the paper transport path and controls the first driving motor to be driven in the paper transport direction again as the sheet enters the paper return path and reaches a position of the paper return path.

6. The driving apparatus as claimed in claim 5, wherein the first driving part comprises a register sensor disposed upstream in the paper transport direction of the developing unit, the second driving part comprises a paper sensor disposed downstream in the paper transport direction of the fixing unit, and the controller obtains information on a stop position and a driving start position of the first driving motor by counting a period of time during which a movement of the sheet is detected by the register sensor and the paper sensor.

7. The driving apparatus as claimed in claim 6, wherein a position at which the driving of the first driving motor is started is set so that a first period of time needed for a process initialization of the developing unit is shorter than a second period of time for a front end of the sheet in a paper progress direction on the paper return path to move to the developing unit after the start of the driving of the first driving motor.

8. The driving apparatus as claimed in claim 7, wherein the controller, in the double-side printing mode, controls the first driving motor to completely stop as the rear end of the sheet exits the developing unit when the sheet is a last printing sheet.

9. The driving apparatus as claimed in claim 8, wherein the second driving motor is, in the double-side printing mode, controlled to be forward rotated for a third period of time after the sheet exits the second roller of the transport part driven by the second driving motor after entering the paper return path.

10. The driving apparatus as claimed in claim 8, wherein the second driving motor is, in the double-side printing mode, controlled to immediately start a forward rotation when the sheet exits the second roller of the transport part driven by the second driving motor after entering the paper return path.

11. A driving method in a double-side printable machine including a main body having a frame, a paper-supplying unit detachably mounted in the frame of the main body, a pickup/transport unit picking up and conveying a sheet of paper loaded in the paper-supplying unit along a paper transport path, a developing unit forming a toner image on the sheet, a fixing unit heat-pressing the toner image formed on the sheet and fixing the toner image as a visible image, a double-side printing unit having a paper return path through which the sheet having one side printed re-enters the developing unit to form another image on a reverse side of the sheet, and having a transport part conveying the sheet through the paper return path, a paper discharge unit discharging the sheet on which the visible image is fixed through the fixing unit, a first driving part having a first driving motor and a first power transfer part transferring power of the first driving motor to the pickup/transport unit, the developing unit, and a first roller of the transport part of the double-side printing unit to drive the pickup/transport unit, the developing unit, and the first roller of the transport part of the double-side printing unit, a second driving part having a second driving motor and a second power transfer part transferring power of the second driving motor to the fixing unit, a second roller of the transport part of the double-side printing unit, and the paper discharge unit to drive the fixing unit, the second roller of the transport part of the double-side printing unit, and the paper discharge unit, and a controller controlling the first and second driving parts, the method comprising:

determining whether a mode is a double-side printing mode;

stopping the first driving motor of the first driving part when a rear end of the sheet passes through the developing unit and reaches a position of the paper transport path upon determining that the mode is the double-side printing mode;

driving the second driving motor of the second driving part in a direction conveying the sheet into the paper return path in the double-side printing mode, and driving the second driving motor in a direction discharging the sheet upon determining that the mode is not the double-side printing mode, when the rear end of the sheet swings in a direction of the paper return path; and driving the first driving motor of the first driving part in the paper transport direction again as the sheet enters the paper return path and reaches a position of the paper return path.

12. The driving method as claimed in claim 11, further comprising:

cutting off a power of the second driving motor from a portion of the paper discharge unit and the fixing unit as the second driving motor is driven in a direction for the sheet to enter the paper return path.

13. The driving method as claimed in claim 12, wherein the developing unit comprises a register sensor disposed upstream to a paper transport direction, and the stopping of the first driving motor comprises:

obtaining information on a stop position of the first driving motor by counting a period of time during which a movement of the sheet is detected by the register sensor.

14. The driving method as claimed in claim 13, wherein the fixing unit comprises a paper sensor disposed downstream in the paper transport direction, and the driving of the first driving motor comprises:

obtaining information on a driving start position of the first driving motor by counting a period of time during which a movement of the sheet is detected by the paper sensor.

15. The driving method as claimed in claim 14, wherein the driving of the first driving motor comprises:

setting a position at which the first driving motor starts driving so that a first period of time needed for a process initialization of the developing unit is shorter than a second period of time during which a front end of the sheet in a paper progress direction on the paper return path moves to the developing unit after starting the driving of the first driving motor.

16. The driving method as claimed in claim 15, further comprising:

completely stopping the first driving motor when a rear end of the sheet is out of the developing unit when the sheet is a last printing sheet.

17. The driving method as claimed in claim 16, further comprising:

driving the second driving motor in a direction for the sheet to be discharged after a stop for a third period of time when the sheet exits the second roller of the transport part driven by the second driving motor after the sheet enters the paper return path upon the double-side printing mode.

18. The driving method as claimed in claim 16, further comprising:

driving the second driving motor in a direction discharging the sheet immediately as the sheet exits the second roller of the transport part driven by the second driving motor after the sheet enters the paper return path upon the double-side printing mode.

19. A driving method in a double-side printable machine including a main body having a frame, a paper-loading unit detachably mounted in the frame of the main body, a pickup/transport unit picking up and conveying sheets of paper loaded in the paper-loading unit along a paper transport path in a paper transport direction, a developing unit forming a toner image on a sheet, a fixing unit heat-pressing the toner image formed on the sheet and fixing the toner image as a visible image, a double-side printing unit having a paper return path along which the sheet having one side printed re-enters the developing unit to form another image on a reverse side of the sheet, and having a transport part conveying the sheet through the paper return path, a paper discharge unit discharging the sheet on which the visible image is fixed through the fixing unit, a first driving part having a first driving motor and a first power transfer part transferring power of the first driving motor to the pickup/transport unit, the developing unit, fixing unit, a portion of the paper discharge unit, and the transport part of the double-side printing unit to drive a first driving motor, the pickup/transport unit, the developing unit, the-first fixing unit, one of paper discharge rollers of the paper discharge unit, and the transport part of the double-side printing unit, a second driving part having a second driving motor and a second power transfer part transferring power of the second driving motor to the rest of the paper discharge unit to drive another one of paper discharge rollers of the paper discharge unit, and a controller controlling the first and second driving parts, the method comprising:

determining whether a mode is a double-side printing mode;

stopping the first driving motor of the first driving part when a rear end of the sheet passes through the developing unit and reaches a position of the paper transport path upon determining that the mode is the double-side printing mode;

driving the second driving motor of the second driving part in a direction conveying the sheet into the paper return path upon the double-side printing mode, and driving the second driving motor in a direction discharging the sheet upon determining that the mode is not the double-side printing mode, when the rear end of the sheet swings in a direction of the paper return path; and driving, upon determining that the mode is the double-side printing mode, the first driving motor of the first driving part in the paper transport direction again when the sheet enters the paper return path and reaches a position of the paper return path.

20. The driving method as claimed in claim 19, wherein the fixing unit comprises a paper sensor disposed downstream in the paper transport direction, and the stopping of the first driving motor comprises:

obtaining information on a stop position of the first driving motor by counting a period of time during which a movement of the sheet is detected by the paper sensor.

21. The driving method as claimed in claim 20, wherein the driving of the first driving motor comprises:

obtaining information on a driving start position of the first driving motor by counting a period of time during which the movement of the sheet is detected by the paper sensor.

22. The driving method as claimed in claim 21, wherein the driving the first driving motor comprises:

setting a position at which the first driving motor starts driving so that a first period of time needed for a process initialization of the developing unit is shorter than a second period of time during which the front end of the sheet in the paper progress direction on the paper return path moves to the developing unit after starting the driving of the first driving motor.

23. The driving method as claimed in claim 22, further comprising:

completely stopping the first driving motor when a third period of time lapses after the rear end of the sheet is out of the fixing unit when the sheet is a last printing sheet.

24. The driving method as claimed in claim 23, further comprising:

driving the second driving motor in a direction for the sheet to be discharged after the first driving motor is completely stopped for a period of time when the sheet exits the another one of the paper discharge rollers of the paper discharge unit driven by the second driving motor after the sheet enters the paper return path in the double-side printing mode.

25. The driving method as claimed in claim 23, further comprising:

driving the second driving motor in a direction discharging the sheet immediately as the sheet is out of the remaining portion of the paper discharge unit driven by the second driving motor after the sheet enters the paper return path upon determining that the mode is the double-side printing mode.

26. A driving apparatus for a double-side printable machine having a pickup/transport unit having a pickup/transport roller, a developing unit having a photosensitive drum, a fixing unit having a fixing roller, a double-side printing unit having a paper return path and a transport part having a first reverse-transport roller and a second reverse-transport roller, and a paper discharge unit having a discharging roller, the driving apparatus comprising:

a first driving part having a first driving motor driving the pickup/transport roller of the pickup/transport unit, the photosensitive drum of the developing unit, and the first reverse-transport roller of the transport part of the double-side printing unit; and a second driving part having a second driving motor driving the fixing roller of the fixing unit, the second reverse-transport roller of the transport part of the double-side printing unit, and the discharging roller of the paper discharge unit.

27. The driving apparatus of claim 26, further comprising:

a controller controlling the first driving part and the second driving part to selectively drive the first driving motor and the second driving motor.

28. The driving apparatus of claim 26, wherein the second driving part comprises:

a power transfer/cutoff part selectively transferring/cutting off a power of the second driving motor to/from the fixing roller of the fixing unit and the first reverse-transport roller of the transport part of the double-side printing unit.

29. The driving apparatus of claim 28, wherein the discharging roller of the paper discharging unit rotates by the second driving motor of the second driving part when the fixing roller of the fixing unit and the first reverse-transport roller of the transport part of the double-side printing unit do not rotate.

30. The driving apparatus of claim 28, wherein the fixing roller of the fixing unit rotates by the second driving motor of the second driving part when the photosensitive drum of the developing unit does not rotate.

31. The driving apparatus of claim 28, wherein the fixing roller of the fixing unit does not rotate when the photosensitive drum of the developing unit rotates by the first driving motor of the first driving part.

32. The driving apparatus of claim 28, wherein the second reverse-transport roller of the transport part of the double-side printing unit rotates by the second driving motor of the first driving part when the first reverse-transport roller of the transport part of the double-side printing unit does not rotate.

33. The driving apparatus of claim 28, wherein the second reverse-transport roller of the transport part of the double-side printing unit does not rotate when the first reverse-transport roller of the transport part of the double-side printing unit rotates by the first driving motor of the first driving part.

34. The driving apparatus of claim 26, wherein the first driving part comprises a first power transfer part transferring a first power of the first driving motor to the pickup/transport roller of the pickup/transport unit, the photosensitive drum of the developing unit, and the first reverse-transport roller of the transport part of the double-side printing unit, and the second driving part comprises:

a second power transfer part transferring a second power of the second driving motor to the fixing roller of the fixing unit, the second reverse-transport roller of the transport part of the double-side printing unit, and the discharging roller of the paper discharge unit.

35. The driving apparatus of claim 34, wherein the second driving motor of the second driving part is turned off when the first driving motor of the first driving part controls the first the pickup/ transport roller of the pickup/transport unit to feed a sheet of paper to the developing unit.

36. The driving apparatus of claim 34, wherein the second driving motor of the second driving part is turned off when the first driving motor of the first driving part controls the photosensitive drum of the developing unit to develop an image formed on the photosensitive drum.

37. The driving apparatus of claim 34, wherein the first driving motor of the first driving part is turned off when the second driving motor of the second driving part controls the fixing roller of the fixing unit to fix an image formed on a sheet of paper by the photosensitive drum of the developing unit.

38. The driving apparatus of claim 34, wherein the first driving motor of the first driving part is turned off when the second driving motor of the second driving part controls the discharging roller of the paper discharging unit to discharge a sheet of paper outside the paper discharging unit.

39. The driving apparatus of claim 34, wherein the first driving motor of the first driving part is turned off when the second driving motor of the second driving part controls the second reverse-transport roller of the transport part of the double-side printing unit to return a sheet of paper to the developing unit.

40. A driving method in a double-side printable machine having a pickup/transport unit having a pickup/transport roller, a developing unit having a photosensitive drum, a fixing unit having a fixing roller, a double-side printing unit having a paper return path and a transport part having a first reverse-transport roller and a second reverse-transport roller, and a paper discharge unit having a discharging roller, the method comprising:

driving a first driving part constituted of the pickup/transport roller of the pickup/transport unit, the photosensitive drum of the developing unit, and the first reverse-transport roller of the transport part of the double-side printing unit using a first driving motor; and driving a second driving part constituted of the fixing roller of the fixing unit, the second reverse-transport roller of the transport part of the double-side printing unit, and the discharging roller of the paper discharge unit using a second driving motor.

41. The driving method of claim 40, further comprising:

selectively driving the first driving motor and the second driving motor.

42. The driving method of claim 40, further comprising:

exclusively driving one of the first driving motor and the second driving motor.

43. The driving apparatus of claim 40, wherein the driving of the second driving part comprises:

selectively transferring/cutting off a power of the second driving motor to/from the fixing roller of the fixing unit and the first reverse-transport roller of the transport part of the double-side printing unit using a power transfer/cutoff part.

44. The driving apparatus of claim 40, wherein the driving of the second driving part comprises:

rotating the discharging roller of the paper discharging unit by the second driving motor of the second driving part when the fixing roller of the fixing unit and the first reverse-transport roller of the transport part of the double-side printing unit do not rotate.

45. The driving apparatus of claim 40, wherein the driving of the second driving part comprises:

rotating the fixing roller of the fixing unit by the second driving motor of the second driving part when the photosensitive drum of the developing unit does not rotate.

46. The driving apparatus of claim 40, wherein the driving of the second driving part comprises:

stopping a rotation of the fixing roller of the fixing unit when the photosensitive drum of the developing unit rotates by the first driving motor of the first driving part.

47. The driving apparatus of claim 40, wherein the driving of the second driving part comprises:

rotating the second reverse-transport roller of the transport part of the double-side printing unit using the second driving motor of the first driving part when the first reverse-transport roller of the transport part of the double-side printing unit does not rotate.

48. The driving apparatus of claim 40, wherein the driving of the second driving part comprises:

stopping a rotation of the second reverse-transport roller of the transport part of the double-side printing unit when the first reverse-transport roller of the transport part of the double-side printing unit rotates by the first driving motor of the first driving part.

* * * * *

UNITED STATES PATENT AND TRADEMARK OFFICE

CERTIFICATE OF CORRECTION

PATENT NO. : 6,810,224 B2
DATED : October 26, 2004
INVENTOR(S) : Byung-sun Ahn

It is certified that error appears in the above-identified patent and that said Letters Patent is hereby corrected as shown below:

Column 17,
Line 47, change “Image” to -- image --.

Column 21,
Line 9, delete “first”.

Signed and Sealed this

Tenth Day of May, 2005

JON W. DUDAS
*Director of the United States Patent and Trademark Office*